US009932769B2

(12) United States Patent
Woolery

(10) Patent No.: US 9,932,769 B2
(45) Date of Patent: Apr. 3, 2018

(54) HIDDEN INSECT SCREEN SYSTEM FOR DOUBLE HUNG, TILT-TO-CLEAN WINDOWS

(71) Applicant: Donald R Woolery, Rockford, IL (US)

(72) Inventor: Donald R Woolery, Rockford, IL (US)

( * ) Notice: Subject to any disclaimer, the term of this patent is extended or adjusted under 35 U.S.C. 154(b) by 0 days.

(21) Appl. No.: 15/204,674

(22) Filed: Jul. 7, 2016

(65) Prior Publication Data

US 2018/0010387 A1 Jan. 11, 2018

Related U.S. Application Data

(60) Provisional application No. 62/193,457, filed on Jul. 16, 2015.

(51) Int. Cl.

| | |
|---|---|
| ***E06B 9/52*** | (2006.01) |
| ***E06B 9/54*** | (2006.01) |
| ***E06B 3/50*** | (2006.01) |
| ***E06B 7/22*** | (2006.01) |

(52) U.S. Cl.

CPC ..... *E06B 9/54* (2013.01); *E06B 3/5063* (2013.01); *E06B 7/22* (2013.01)

(58) Field of Classification Search

CPC ..... E06B 9/54; E06B 2009/546

USPC ..... 160/27, 28, 99, 100, 41, 96

See application file for complete search history.

(56) References Cited

U.S. PATENT DOCUMENTS

| | | | | | |
|---|---|---|---|---|---|
| 114,548 | A * | 5/1871 | Giroux | E06B 9/54 | 160/27 |
| 136,740 | A * | 3/1873 | Lippincott | E06B 9/54 | 160/21 |
| 149,770 | A * | 4/1874 | May | E06B 9/262 | 160/84.06 |
| 151,599 | A * | 6/1874 | Kells | E06B 9/54 | 160/23.1 |
| 201,714 | A * | 3/1878 | Stuart | B60J 1/2011 | 160/105 |
| 204,375 | A * | 5/1878 | Reynolds | E06B 9/54 | 160/273.1 |
| 208,700 | A * | 10/1878 | Wockey | E06B 9/50 | 160/242 |

(Continued)

FOREIGN PATENT DOCUMENTS

| | | |
|---|---|---|
| DE | 102008047264 | 10/2008 |
| EP | 2775088 | 10/2014 |

(Continued)

*Primary Examiner* — Blair M Johnson
*Assistant Examiner* — Johnnie A. Shablack

(57) ABSTRACT

A hidden insect screen system for tilt-to-clean, double hung windows whereby raising the bottom sash (104) causes resultant opening to fill with insect screen (115*a*) dispensed from an ordinary self-storing roller mechanism (114) mounted inside bottom rail (109) of said sash and whereby lowering the upper sash (105) causes resultant opening to fill with insect screen (115*b*) dispensed from an ordinary self-storing roller mechanism (122) mounted inside window head frame (103), all furnished such that vertical edges of the screens are protected from insect passage by contacting weatherstrip-like edge seals (127), and arranged such that insect protection is maintained with minimal interruption when each sash is tilted and its glazing is cleaned, the lower end of the upper screen being attached so as to be quickly repositioned from top to bottom of said upper sash.

13 Claims, 12 Drawing Sheets

(56) References Cited

U.S. PATENT DOCUMENTS

| | | | | | |
|---|---|---|---|---|---|
| 277,111 | A * | 5/1883 | Carman | E06B 9/54 | 160/273.1 |
| 507,011 | A * | 10/1893 | Jay | E06B 9/54 | 160/100 |
| D33,945 | S * | 1/1901 | Crocker | D25/164 | |
| 918,585 | A * | 4/1909 | Paddison | E06B 9/54 | 160/122 |
| 960,388 | A * | 6/1910 | Paddison | E06B 9/50 | 160/122 |
| 1,118,086 | A * | 11/1914 | White | E06B 9/54 | 160/100 |
| 1,167,526 | A * | 1/1916 | Scheeren | E06B 9/54 | 160/122 |
| 1,223,934 | A * | 4/1917 | Charlton | E06B 9/54 | 160/23.1 |
| 1,349,438 | A * | 8/1920 | Stanislaw | E06B 9/54 | 160/100 |
| 1,653,788 | A * | 12/1927 | Stein | E06B 3/50 | 160/20 |
| 1,764,880 | A * | 6/1930 | Nelson | E06B 9/54 | 160/267.1 |
| 1,799,671 | A * | 4/1931 | Blackburn | E06B 9/52 | 160/94 |
| 1,859,209 | A * | 5/1932 | Kohlsaat | E06B 9/54 | 160/122 |
| 1,996,108 | A * | 4/1935 | Herr | E06B 9/66 | 160/122 |
| 2,051,422 | A * | 8/1936 | Rissmann | E06B 9/54 | 160/25 |
| 2,056,341 | A * | 10/1936 | Bulmer | E06B 9/54 | 160/28 |
| 2,079,718 | A * | 5/1937 | Sgritta | E06B 9/54 | 160/27 |
| 2,191,166 | A * | 2/1940 | Dollstedt | E06B 9/54 | 160/28 |
| 2,311,413 | A * | 2/1943 | Sigfrid | E06B 9/54 | 160/20 |
| 2,386,986 | A * | 10/1945 | Shirley | E06B 9/92 | 160/22 |
| 2,406,761 | A * | 9/1946 | Golkowski | E06B 9/54 | 160/100 |
| 2,432,808 | A * | 12/1947 | Royak | E06B 9/54 | 160/27 |
| 2,462,520 | A * | 2/1949 | Marbach | E06B 9/54 | 160/100 |
| 2,491,555 | A * | 12/1949 | Fistor | E06B 9/54 | 160/30 |
| 2,514,274 | A * | 7/1950 | Zagrodny | E06B 9/54 | 160/27 |
| 2,573,590 | A * | 10/1951 | Mosebach | E06B 9/54 | 160/27 |
| 2,632,507 | A * | 3/1953 | Ewing | E06B 9/52 | 160/328 |
| 2,637,381 | A * | 5/1953 | Bowman | E06B 3/40 | 160/210 |
| 2,825,400 | A * | 3/1958 | Poulsen | E06B 9/54 | 160/30 |
| 3,005,489 | A * | 10/1961 | Crocker | E06B 9/54 | 160/28 |
| 3,008,518 | A * | 11/1961 | Hayes | E06B 9/54 | 160/27 |
| 3,105,542 | A * | 10/1963 | Lynch | E06B 9/54 | 160/28 |
| 3,155,146 | A * | 11/1964 | Malouf | E06B 9/54 | 160/100 |
| 3,158,195 | A * | 11/1964 | Ney | E06B 9/54 | 160/26 |
| 3,173,474 | A * | 3/1965 | Wootten | E06B 9/54 | 160/100 |
| 3,470,934 | A * | 10/1969 | Agnew | E06B 9/54 | 160/100 |
| 3,552,471 | A * | 1/1971 | Hurst | E06B 9/54 | 160/27 |
| 3,911,990 | A * | 10/1975 | Hoover | E06B 9/54 | 160/100 |
| 4,862,942 | A * | 9/1989 | Johnson | E06B 9/54 | 160/120 |
| 5,301,734 | A * | 4/1994 | Opel | E05D 15/22 | 160/100 |
| 5,363,898 | A * | 11/1994 | Sprague | E05D 13/1276 | 160/191 |
| 5,544,689 | A * | 8/1996 | Wegner | E06B 9/54 | 160/100 |
| 5,787,952 | A * | 8/1998 | Wegner | E06B 9/54 | 160/100 |
| 5,915,443 | A * | 6/1999 | Lindley, Jr. | E06B 9/54 | 160/100 |
| 6,167,936 | B1 * | 1/2001 | Stover | E06B 9/54 | 160/100 |
| 6,186,215 | B1 * | 2/2001 | DeYoung | E06B 9/42 | 160/100 |
| 6,209,610 | B1 * | 4/2001 | Davies | E05D 15/0604 | 160/100 |
| 6,223,803 | B1 * | 5/2001 | Nielsen | E06B 9/42 | 160/100 |
| 6,470,947 | B1 * | 10/2002 | Holevas | E06B 7/03 | 160/100 |
| 6,499,527 | B1 * | 12/2002 | Lindley, Jr. | E06B 9/40 | 160/271 |
| 213,564 | A1 | 11/2003 | Pacholke | | |
| 6,679,002 | B2 * | 1/2004 | Davies | E05D 15/0604 | 49/322 |
| 22,943 | A1 | 2/2005 | Thomas et al. | | |
| 173,075 | A1 | 8/2005 | Abelson et al. | | |
| 199,665 | A1 | 9/2007 | Studney | | |
| 284,052 | A1 | 12/2007 | Thomas et al. | | |
| 115,203 | A1 | 3/2009 | Thomas et al. | | |
| 7,703,498 | B2 * | 4/2010 | Holevas | E06B 9/60 | 160/100 |
| 7,788,864 | B2 * | 9/2010 | Jacobsen | E04D 13/033 | 52/204.5 |
| 7,819,167 | B2 * | 10/2010 | Morin | E06B 7/03 | 160/102 |
| 108,209 | A1 | 5/2011 | Thomas et al. | | |
| 98,566 | A1 | 4/2013 | Horvath | | |
| 2003/0213564 | A1 * | 11/2003 | Pacholke | E06B 9/40 | 160/98 |
| 2005/0022943 | A1 * | 2/2005 | Thomas | E06B 5/003 | 160/27 |
| 2005/0173075 | A1 * | 8/2005 | Abelson | E06B 9/54 | 160/30 |
| 2007/0199665 | A1 * | 8/2007 | Studney | A47H 99/00 | 160/99 |
| 2007/0284052 | A1 * | 12/2007 | Thomas | E06B 5/003 | 160/27 |
| 2009/0115203 | A1 * | 5/2009 | Thomas | E06B 5/003 | 292/336.3 |
| 2013/0098566 | A1 * | 4/2013 | Horvath | E06B 9/58 | 160/273.1 |

FOREIGN PATENT DOCUMENTS

| | | |
|---|---|---|
| EP | 2821582 | 7/2015 |
| JP | 080869 | 3/2000 |
| JP | 080870 | 3/2000 |
| JP | 080871 | 3/2000 |
| JP | 227265 | 8/2001 |

* cited by examiner

Prior Art: "Screen Away"

HIDDEN INSECT SCREEN SYSTEM FOR DOUBLE HUNG, TILT-TO-CLEAN WINDOWS

CROSS REFERENCE TO RELATED APPLICATIONS

This application claims the benefit of provisional patent application Ser. No. 62/193,457, filed 2015 Jul. 16 by the present inventor, which is incorporated by reference.

FEDERALLY SPONSORED RESEARCH

None.

SEQUENCE LISTING

None.

BACKGROUND

This application relates to window screens for inclusion into windows commonly known as double hung which comprise an upper moving sash and a bottom moving sash that operate by translating up and down, the bottom sash directly to the room side of the upper sash, and more specifically such windows that are furnished with hardware to allow the moving sashes to tilt their tops inward in order to facilitate cleaning of the exterior glass from inside the building.

When double hung windows are opened to pass air from the outdoors they are protected from the intrusion of flying insects with fabric screens. Besides the familiar designs where window makers attach screen fabric in rigid frames to the exterior of their window assemblies, several products are manufactured to provide retractable, rollup screens that operate within a frame applied around the perimeter of an installed window.

Several patents have been issued for vertical as well as horizontal sliding window assemblies that incorporate retractable, rollup screens, as does the design presented herein. Those patents commonly present details about how their rollup mechanisms are to work. However, the rollup mechanisms presented herein are not dependent on any of the claims of those devices and the rollup mechanisms for the design disclosed herein may be any of the rollup mechanisms commonly available on the market.

Several patents have also been issued for window assemblies with retractable, rollup screen mechanisms incorporated either into their sashes or into their perimeter frame assemblies or both, as does the design presented herein. The closest of these designs to the design presented herein is the first embodiment of U.S. Pat. No. 5,915,443 (1999), to Jack Lindley, Jr., which discloses a double hung window with a rollup insect screen mounted inside the bottom rail member of its bottom moving sash with its screen attached to the window sill, just as the design presented herein. However, the free edges of the screen in that embodiment, that is the edges stretching between the screen rollup mechanism and the window sill, are not protected from intrusion of insects, the fabric being left with each of its vertical edges running free at unspecified distances from the faces of the adjacent jamb members in the surrounding window frame.

Additionally in that embodiment, Lindley presents what he calls a pivotable flap attached to the lower sash and enclosed by the meeting rails, very much like the fin baffle presented herein; however, the design presented herein attaches that fin baffle to the opposite meeting rail and uses said fin baffle for a purpose not anticipated by the Lindley embodiment; that is, it is used to close off the gap between the lower sash and the upper sash that occurs when the lower sash is tilted for cleaning and, therefore, the fin baffle for the design presented herein is not the same as the pivotable flap presented by Lindley.

Lindley also discloses in that U.S. Pat. No. 5,915,443 another embodiment wherein a rollup screen is dispensed from a roller mounted onto the window sill at its room side, with the translating horizontal end of the screen fabric attached to the bottom of the bottom sash, as with an alternate design embodiment presented herein. Lindley, with that embodiment, protected the free edges of the screen fabric from insect intrusion by providing a track to enclose said edges. However, the alternate design embodiment presented herein, although it appears similar, does not require such a track. Also, the placement of the screen rollup mechanism presented herein improves on the Lindley design by being upside down from said embodiment, which upside down placement protects the rollup mechanism, unlike the Lindley design, from accumulations of wind-blown rain and snow that can corrode working parts.

All of the rollup screen systems I can find in the patent literature, except for the first embodiment of the Lindley design, attempt to address the problem of how the free edges of their screen fabric may be provided with a secure deterrent to the passage of flying insects. Universally, those patents conceive to solve the problem by either a means of attaching those edges to the window jambs or by providing some sort of track system enclosing those edges; but such track systems and attachment systems always require devices to be fitted to the window jambs, which devices inhibit the tilting of sashes for cleaning.

The only exception I have found to these two concepts for protecting such free edges is in the Screen Away products of the Larson Manufacturing Company of South Dakota, illustrated in FIG. 13, which products form the insect seal by stretching the free edges of the screen fabric across the face of fiber pile weatherstripping, with such weatherstripping being mounted to the weather side of the screen fabric on a rigid fin affixed to the window jamb, parallel to the plane of the screen fabric and with the opposite face of the screen fabric being confined by a structure provided for an adjacent sliding sash. That, in effect, places the edge of the Larson screen fabric in a track-like enclosure such that if, for the sake of argument, the sliding Screen Away sash were to be made so that it could tilt, the fabric would require being withdrawn from its track-like enclosure and reinserted in order to complete tilt-to-clean window washing. My experience with said Screen Away products reveals that although said withdrawal and reinsertion is rather easy remote from the rollup roller, it is impossible near to the rollup roller without tearing the screen fabric and, thus, the Screen Away design cannot be conceived to be suitable for tilt-to-clean windows.

The design presented herein, however, is suitable for tilt-to-clean windows; that is, the person washing a tilt-to-clean window fitted as disclosed herein will be able to tilt and clean the sash as with typical tilt-to-clean windows except for one or two quickly accomplished additional procedures of minimal effort, none of which require tools.

In conclusion, in so far as I am aware, no bottom sash of a hung window of the tilt-to-clean variety has ever been protected against intrusion of flying insects by having a self-storing rollup insect screen incorporated into the bottom rail of said sash or incorporated to the room side of its sill such that the insect screen is rolled out to protect the ventilation opening in the same operation that moving of the lower sash creates such ventilation opening, while also not requiring any rearrangement of the insect protection components in order for the lower sash to be tilted for the convenient cleaning of its exterior glass surfaces.

Nor do I believe that there has ever been an upper sash for a double hung window of the tilt-to-clean variety protected against intrusion of flying insects by having a self-storing rollup insect screen incorporated into the head frame of the window such that the insect screen is rolled out to protect the ventilation opening in the same operation that moving of the upper sash creates such ventilation opening, while also providing during the tilting of the upper sash for the convenient cleaning of its exterior glass surfaces, an expedient means of transporting the bottom end of said screen from the top of said sash to the bottom of said sash along its weather side by incorporating guide tracks into the sash or by clip attachment-and-reattachment systems.

SUMMARY

A common self-storing rollup insect screen is retained inside the bottom rail of the bottom sash of a double hung window of the tilt-to-clean variety such that the screen passes through an opening in said rail; and said screen, by being attached to the sill of the window, allows the ventilation opening created by lifting of said sash to be filled with insect screen matching the size of said ventilation opening according to the actual size said opening varies while said sash is opening and closing, all of which is arranged, by benefit of various weatherstripping arrangements, to allow insect protection to be maintained as said sash is tilted for cleaning, without requiring the user to consciously rearrange the insect protection system.

Also, a common self-storing rollup insect screen is retained inside the head of the frame of said window, such that the screen passes through an opening in the bottom of said frame, and said screen, by being attached to the top of the upper sash, allows the ventilation opening created by lowering of said sash to be filled with insect screen matching the size of said ventilation opening according to the actual size of the opening as it varies while said window sash is opening and closing, all of which is arranged, by benefit of various weatherstripping arrangements, to allow said sash to tilt for cleaning, without requiring the user to do more than relocate the bottom of said screen from the top of said sash to the bottom of said sash in order for insect exclusion to be maintained during said cleaning.

Alternately, another embodiment, varying from the first in various ways but most distinctly by having its rollup insect screen for the bottom sash dispensed from an enclosure at the room side of the window sill.

ADVANTAGES

Several advantages are furnished, in particular:

(a) Visibility through the window is increased since the degradation of visibility that comes with looking through screens is reduced to only the times the window is actually open for ventilation.

(b) The undesirable affinity of insect screens to collect atmospheric dust and pollutants, which can limit visibility and decompose screen fabric, is limited to only the times the window is open.

(c) The screen fabric is subjected to the degrading UV rays of the sun only when the window is open.

(d) Said design is more convenient to operate than rollup self-storing screening systems manufactured for application over a window after the window is installed.

(e) Said design could be less expensive to acquire than rollup systems applied to existing windows since the design seems to require less material and fewer manufacturing processes than such systems.

(f) The entire insect screen storage assembly is always hidden from view which eliminates the visual clutter of add-on room-side screening systems.

(g) The design rids the need for removal of household dust from additional surfaces created when add-on screening systems are installed over the inside of an existing window, (h) The design eliminates the objections of those who dislike seeing on the exteriors of buildings dark, dirty screens permanently exposed to view.

(i) By the rollup assemblies being in the head frame, a bottom rail or in the window frame above the level of the sill, such rollup mechanisms are protected from accumulations of rain and snow and the resultant corrosive effects.

(j) The design conveniently accommodates tilt-to-clean operations, such window arrangements becoming more and more in demand by building owners and home owners.

DRAWINGS

DETAILED DESCRIPTIONS OF DRAWINGS

Figure 1:
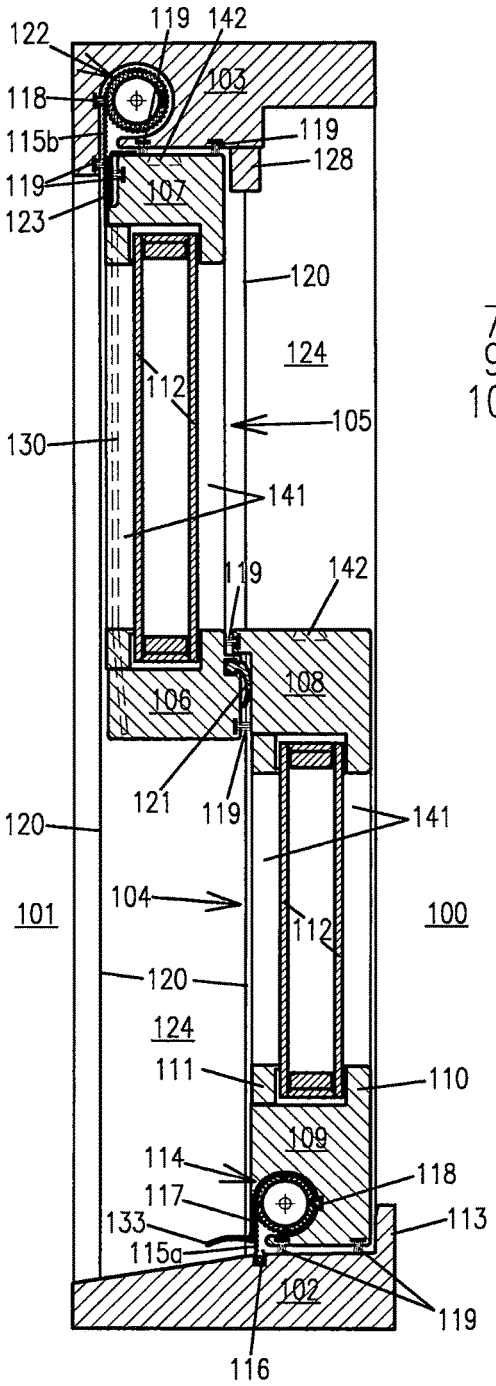
FIG. 1 is a vertical section of the first embodiment through a closed double hung window.
Figure 11:
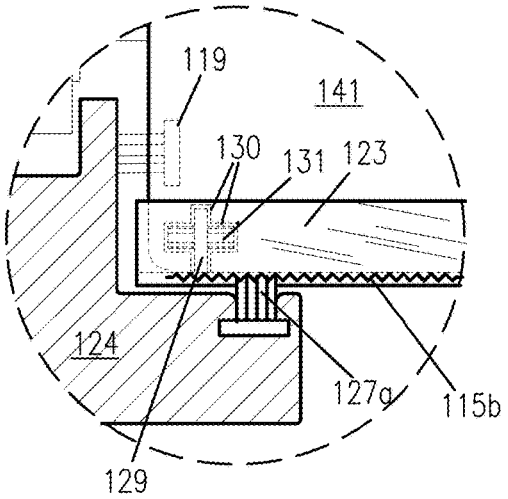
FIG. 11 is a detailed partial horizontal section of the first embodiment where the jamb and an edge seal meet the screen rail above a weather-side track.

FIG. 1 is a vertical sectional view of the first embodiment with the cut taken through a closed double hung window having screen fabrics 115*a* and 115*b* positioned to roll off their respective storage roller assemblies 114 and 122 at the weather side 101, with sash balance/guides 126 and trackways 125 for upper sash 105 and lower sash 104 as well as their respective edge seals 127 not shown in jamb 124 for the sake of increasing clarity. The glazing 112 may be of any type applicable to window fenestration. The expanses of said glazing are shown of less extent than is typical for an actual window installation in order to economize the drawing. The sill 102, head frame member 103 and sash rails 106, 107, 108 and 109 are shown only in profile as though they are made of traditional solid wood but they may as readily be made with any one of the newer hollow constructions such as pultruded plastic or extruded aluminum or extruded plastic which have longitudinal chambers formed by various longitudinal ribs placed according to where a window manufacturer deems suitable. The joint between the meeting rails, that is head rail 108 of bottom sash 104 and bottom rail 105 of upper sash 105, may be sealed against the weather by any traditional means of window construction such as the arrangement of conventional weatherstripping 119 shown. At the room side 100 of the bottom rail 106 of upper sash 105, a fin baffle 121 is attached, made from any of a variety of commonly available fin type flexible weatherstripping products, and is held in a collapsed position by the top rail 108 of bottom sash 104 when said sashes are closed. The sill 102 is shown with sill baffle 113 which may or may not be deemed necessary by various window manufacturers. The sash rails 106, 107, 108 and 109, are each shown with a fixed glazing stop 110 and a removable glazing stop 111 which are typical to window sash constructions. The screen fabric for the lower sash 115*a* is shown attached to said sill with an elastic spline in a channel 116, as is typical to window screen construction, but may be attached by other means including adhesives, chemical welding, heat welding and mechanical fasteners, none of which methods are shown. Lower rollup screen assembly 114 and upper rollup screen assembly 122 may be any commercially available unit manufactured for this purpose. Said rollup screen assemblies are each mounted in a longitudinal cavity by way of their standard brackets according to arrangements convenient to the window manufacturer. Said cavity in lower sash 104 is open to sill 102 below it as is the cavity in head frame 103 correspondingly open to the top of upper sash 105. Each said cavity is sealed against insect passage with a cavity seal 118 made from any of a variety of commonly available weatherstripping products. Lower rollup screen assembly 114 is enclosed on its weather side 101 by a thin, rigid facing or cavity enclosure 117. Connected to said cavity enclosure is a longitudinal auxiliary baffle 133, further explained in the description of FIG. 5. The weather exclusion seal along bottom rail 109 of bottom sash 104 where it meets sill 102 may be accomplished with various kinds and arrangements of weatherstripping as deemed suitable by the window manufacturer irrespective of how weatherstripping pieces 119 are shown. Similarly, the weather sealing of upper rail 107 of upper sash 105 to head frame 103 may be accomplished with various kinds and arrangements of weatherstripping as deemed suitable by the window manufacturer irrespective of how weatherstripping pieces 119 are shown. Head frame 103 is shown with a head baffle 128 which may or may not be deemed necessary by various window manufacturers. The upper screen fabric 115*b* is connected to top rail 107 of said upper sash by way of a screen rail 123 having at each of its ends a bracket 129 configured to slide in track 130, said track being recessed into a vertical face of each stile 141 of said sash. Said tracks may be recessed into sash faces facing the adjacent jamb 124, as shown here, or in the sash faces facing the weather side 101, as shown in FIG. 11.

Figure 2:
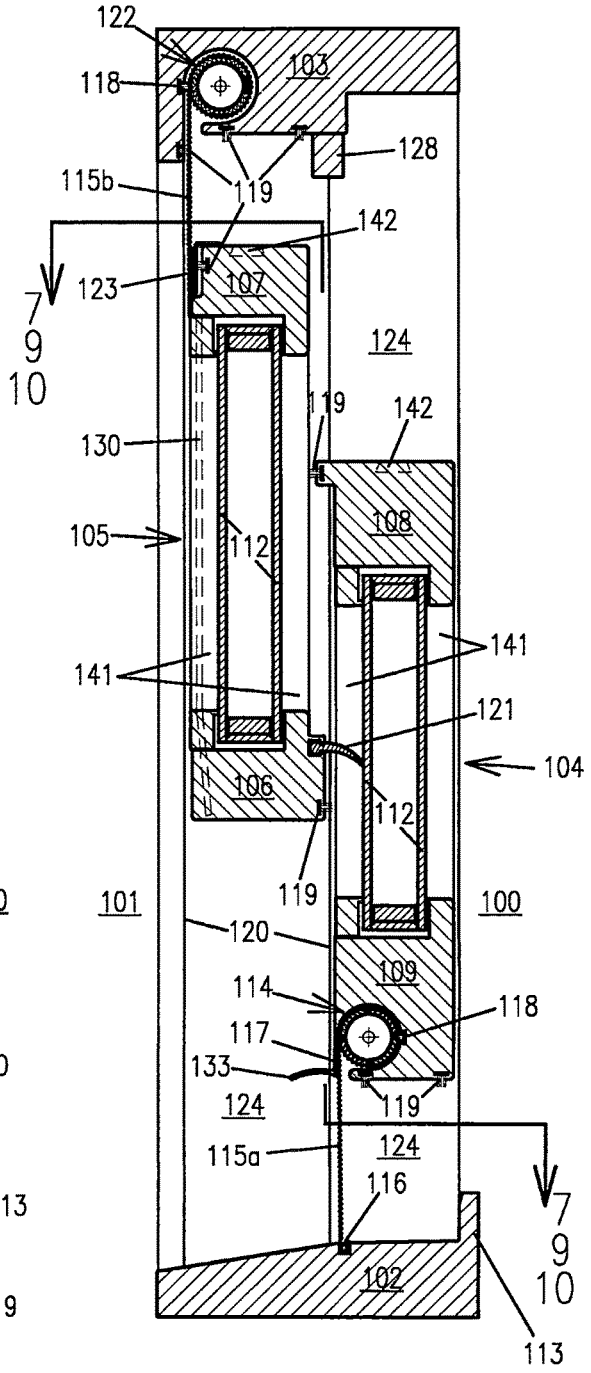
FIG. 2 is a vertical section of the first embodiment through a double hung window with both sashes open.

FIG. 2 is a vertical sectional view of the first embodiment through the window assembly with bottom sash 104 partially raised and upper sash 105 partially lowered, with sash balance/guides 126 and trackways 125 for upper sash 105 and lower sash 104 as well as their respective edge seals 127 not shown in jamb 124 for the sake of increasing clarity. Since said sashes are open and not closed, fin baffle 121 is extended rather than in its collapsed position as shown in FIG. 1.

Figure 3:
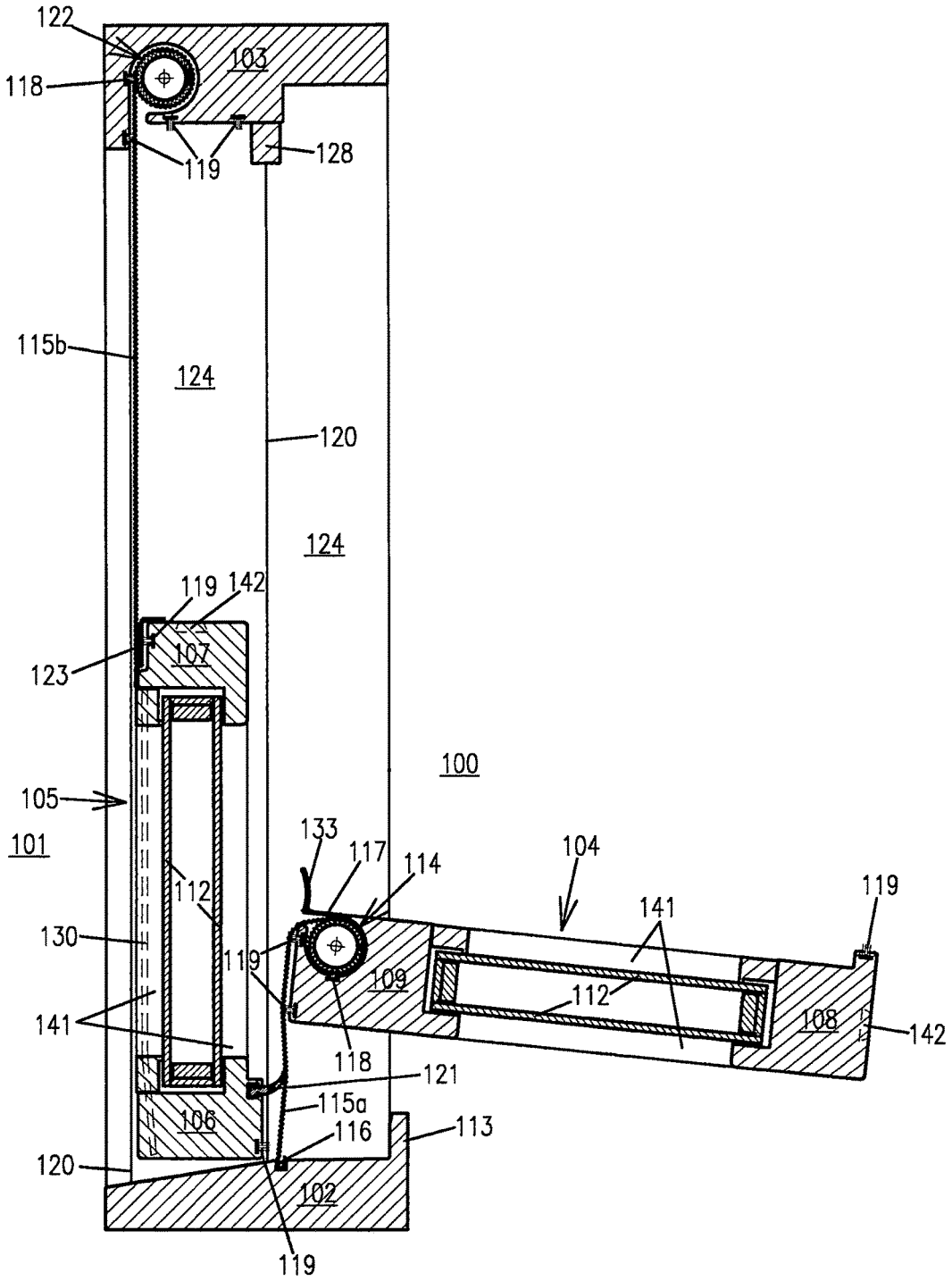
FIG. 3 is a vertical section of the first embodiment with the bottom sash tilted for cleaning.

FIG. 3 is a vertical section of the first embodiment, with sash balance/guides 126 and trackways 125 for upper sash 105 and lower sash 104 as well as their respective edge seals 127 not shown in jamb 124 for the sake of increasing clarity. Bottom sash 104 is in its tilted position, the standard tilt release and upper guide 142 at each jamb 124 having been actuated to disengaged the upper part of said sash from said jambs, allowing said sash to rotate about its sash balance and lower guide 126 so that said sash may be accessed for cleaning. Upper sash 105 has been lowered down to sill 102 to provide protection against insects during said cleaning. Extended fin baffle 121 is also able to cut off passage of insects by pressing on the adjacent screen fabric 115*a* in case said upper sash is not pushed tight to said sill.

Figure 4:
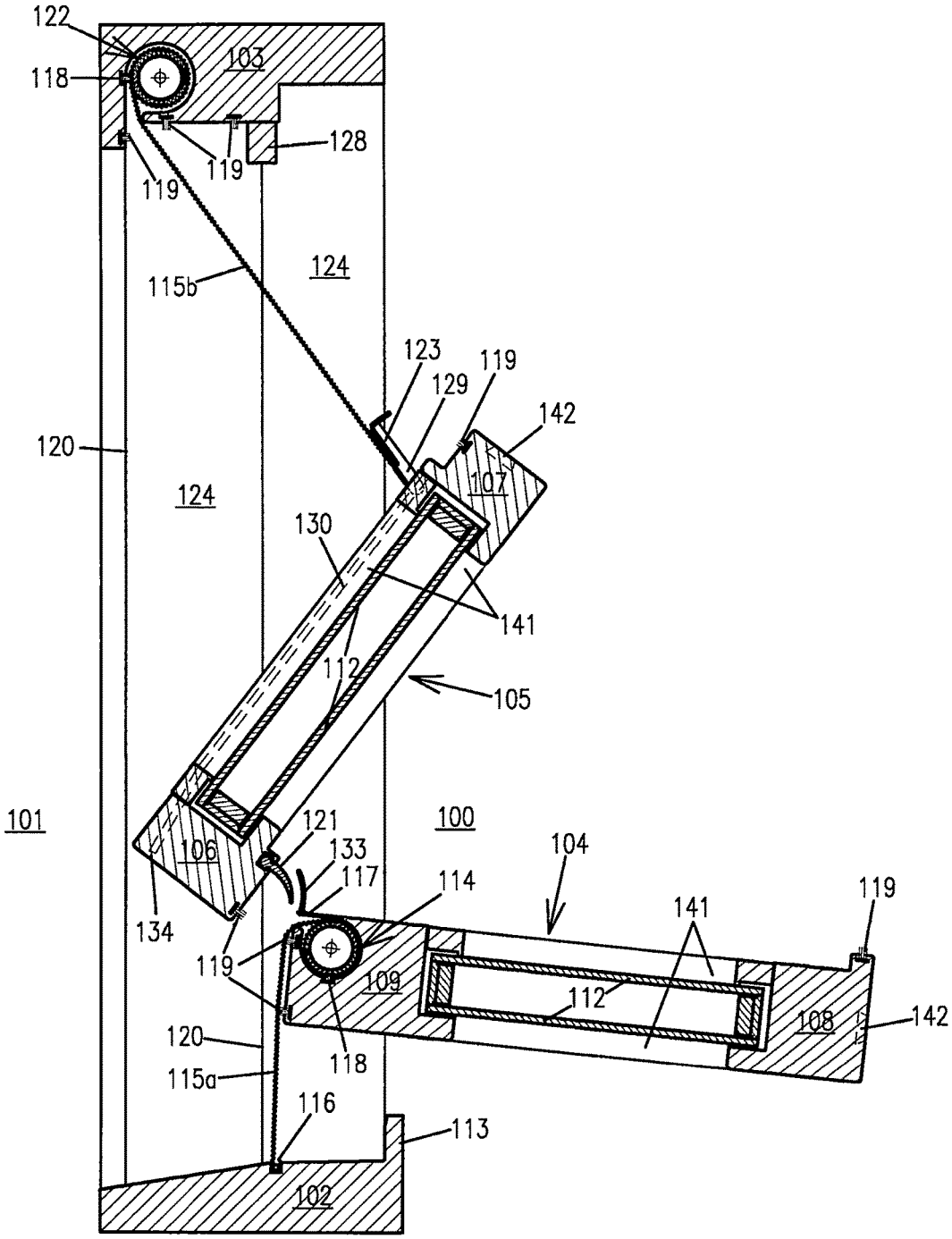
FIG. 4 is a vertical section of the first embodiment with the upper sash beginning to tilt for cleaning.

FIG. 4 is a vertical section of the first embodiment through the window assembly, with sash balance/guides 126 and trackways 125 for upper sash 105 and lower sash 104 as well as their respective edge seals 127 not shown in jamb 124 for the sake of increasing clarity. Upper sash 105 is shown beginning its tilt for cleaning which, because of the tension in upper screen fabric 115*b*, draws screen rail 123 away from the top of said sash while keeping said screen rail attached to said sash by way of pivoting end brackets 129.

Figure 5:
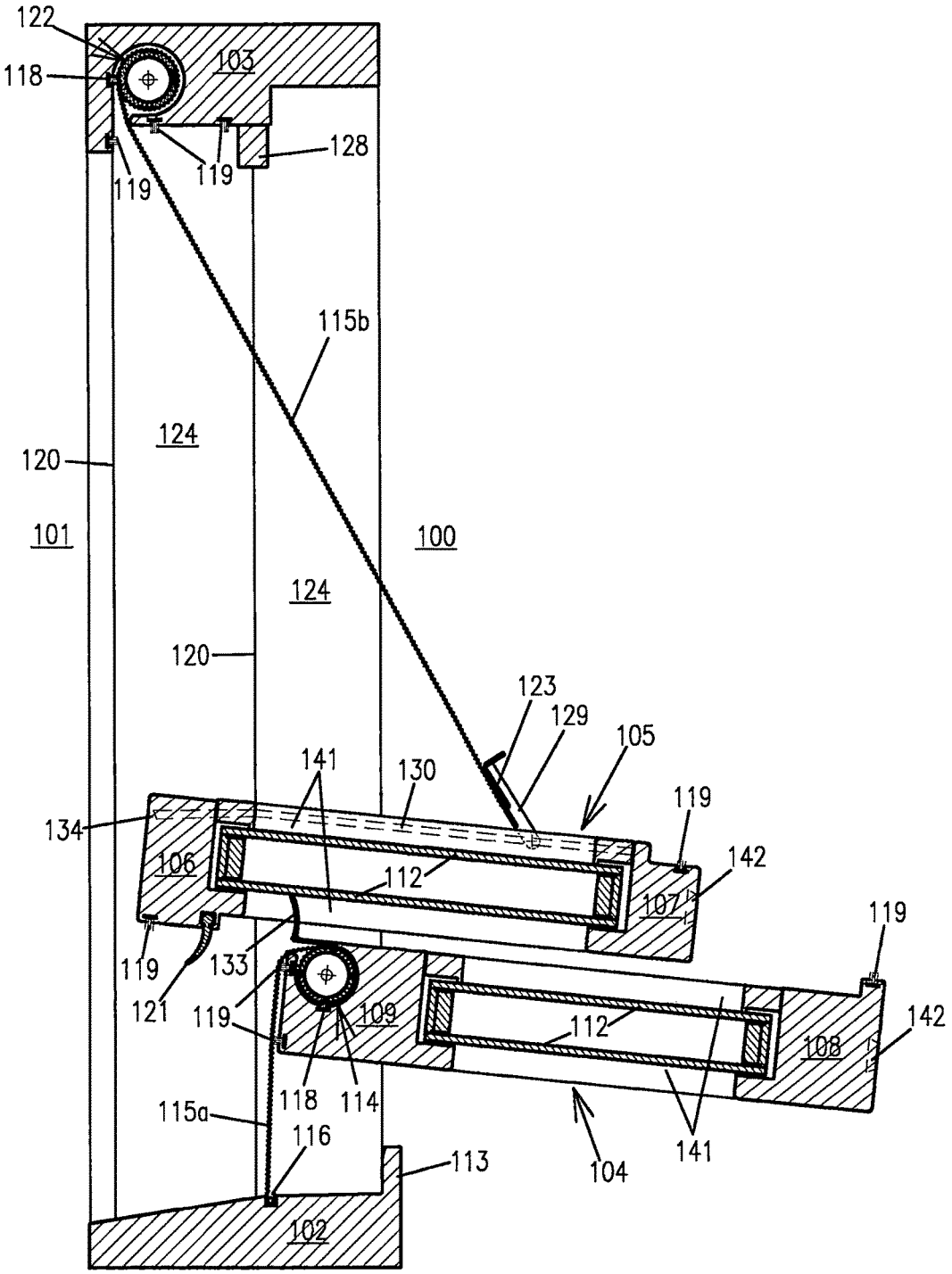
FIG. 5 is a vertical section of the first embodiment with the upper sash tilted for cleaning and its attendant screen beginning to slide out of the way for cleaning operations.

FIG. 5 is a vertical section of the first embodiment, with sash balance/guides 126 and trackways 125 for upper sash 105 and lower sash 104 as well as their respective edge seals 127 not shown in jamb 124 for the sake of increasing clarity. Upper sash 105 is shown tilted into position for cleaning of its exterior glass 112, as screen rail 123 begins to slide down track 130, guided by its accompanying end brackets 129, which action exposes the outside of glass 112 for cleaning operations. Said track is recessed into upper sash 105 such that its longitudinal axis runs parallel to the weather side 101 of said sash, which is shown as the upper surface in this figure, said track running straight until it crosses bottom rail 106 where said track bends, causing the distance between said track and said weather surface to constantly increase. Simultaneously with tilting of said upper sash over lower sash 104, auxiliary baffle 133, being made of a flexing material in order to avoid damaging the glass 112, fills the gap between said upper sash and said lower sash, mitigating against the passage of flying insects through that gap.

Figure 6:
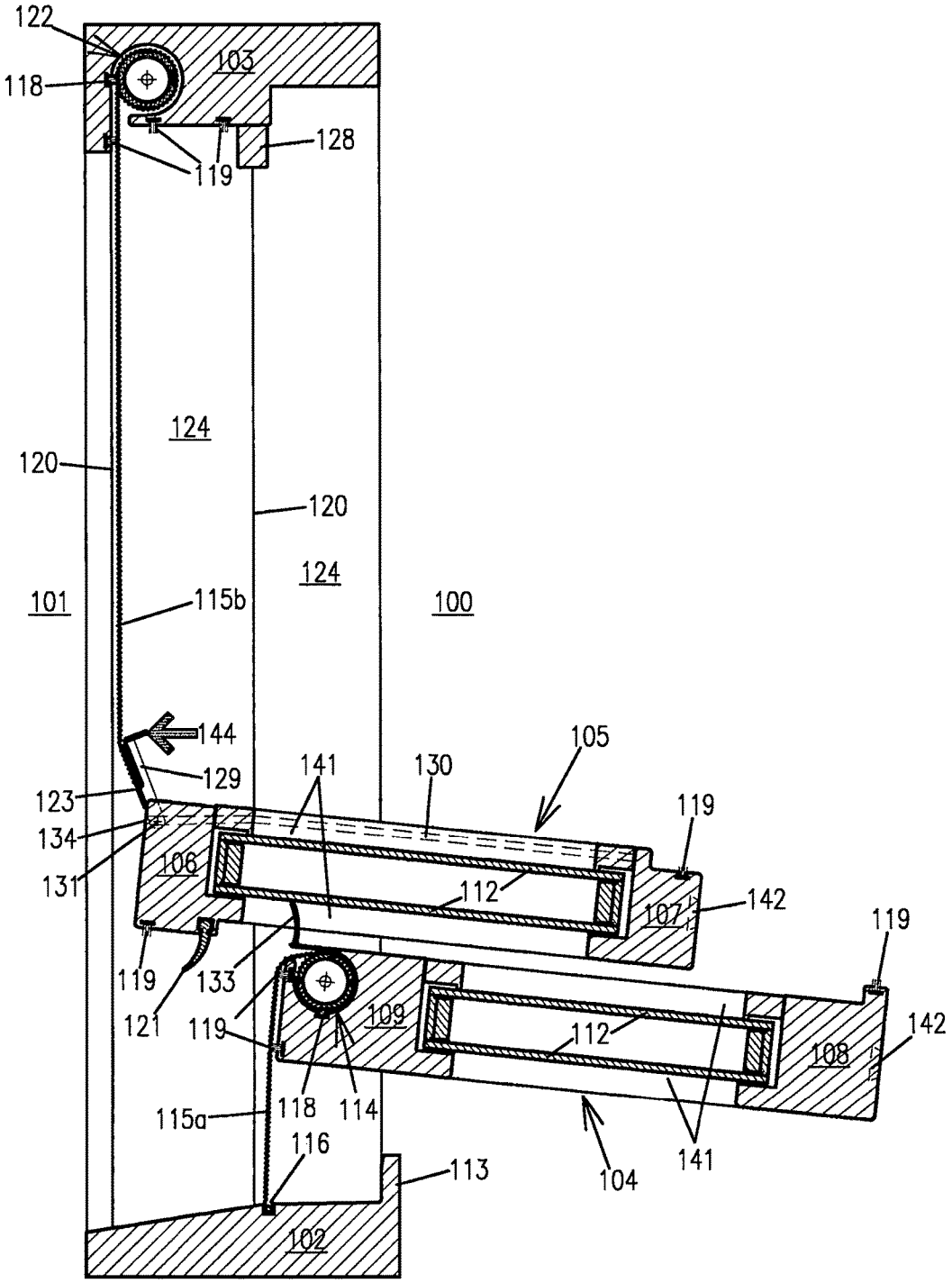
FIG. 6 is a vertical section of the first embodiment with the upper sash tilted for cleaning and its attendant screen locked out of the way of cleaning operations.

FIG. 6 is a vertical section of the first embodiment, with upper sash 105 tilted for cleaning. Sash balance/guides 126 and trackways 125 for upper sash 105 and lower sash 104 as well as their respective edge seals 127 are not shown in jamb 124 for the sake of increasing clarity. Application of manual force 144 to screen rail 123 causes said screen rail to move toward track stops 130*a* at the end of each track 130, where continuation of said force latches said screen rail by overcoming the resistance of the bottom of said screen rail to pass over the outside corner of bottom rail 106. With said screen rail snap-latched into place, the outside surface of the glazing 112 for said upper sash is free for cleaning and the vertical edges of screen fabric 115*b* are placed against jamb shoulder 120 in each jamb, allowing said screen edges to be sealed with their respective edge seals 127 per FIG. 7, FIG, 9 and FIG. 10 until cleaning operations are complete, at which time lifting up of top rail 107 causes said upper sash to rotate sufficiently to force said screen rail back over the outside corner of bottom rail 106, releasing said screen rail which in turn allows said screen fabric to return up track 130 and retract onto its rollup screen assembly 122.

Figure 7:
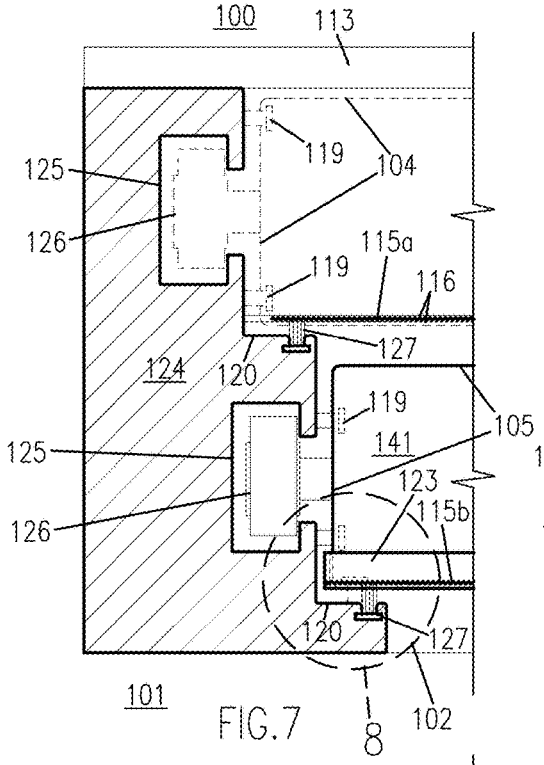
FIG. 7 is a partial horizontal section of the first embodiment through the jamb member of the open window as equipped with pile type edge seals.
Figure 8:
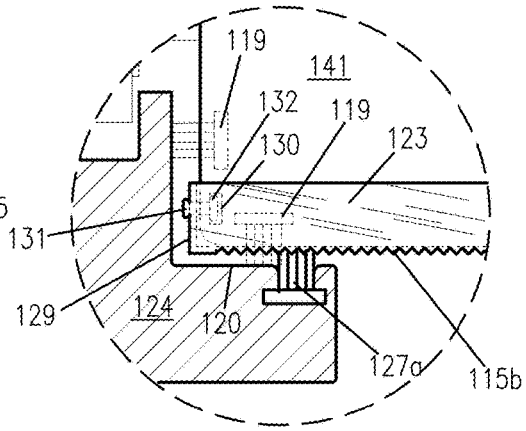
FIG. 8 is a detailed partial horizontal section of the first embodiment where the jamb and edge seal meet the screen rail above a jamb-side track.

FIG. 7 is a partial horizontal section of the first embodiment through jamb 124 of the window assembly with the cutting plane as indicated in FIG. 2, showing how the edges of the screen fabrics 115*a* and 115*b* meet their respective edge seals 127*a*. Said jamb and the sash stiles 141 are shown only in profile as though made of traditional solid wood but they may as readily be made with any one of the newer hollow constructions such as pultruded plastic or extruded aluminum or extruded plastic which have longitudinal chambers formed by various longitudinal ribs placed according to where a window manufacturer deems suitable. Lower sash 104 is furnished, in each of both jambs, with a pivoting balance/guide assembly 126 running in a trackway 125 as is typical to tilt-to-clean windows, the specifics of which are as deemed suitable by the window manufacturer; and upper sash 105 is furnished in the same manner FIG. 8 is a detailed partial horizontal section through jamb 124 of the first embodiment, where upper screen 115*b* meets its edge seal 127*a* at the top of the edge stile 141 of upper sash 105. Said upper sash may be configured to seal against the weather by various arrangements of weatherstripping 119 as deemed suitable by the window manufacturer irrespective of the weatherstripping arrangements shown. FIG. 8 anticipates there possibly being a need for the weatherstripping on said sash to occur opposite an edge seal 127*a*, in which case, neither said weatherstripping nor said edge seal need be compromised since the sash weatherstripping furnished can be of a type, such as fiber pile, that will slide past said edge seal. Longitudinal screen rail 123 connects screen fabric 115*b* to said sash by way of end bracket 129 at each end of said rail, each said bracket having an end that pivotally engages track 130 by various possible arrangements that allow said tracks to guide the travel of said brackets along stile member 141 at each side of said sash, traveling from the top of said sash to the bottom of said sash. One such means of said bracket engaging said track is illustrated, consisting of a pivot 131 and sliding shoe 132 in a T-profile track 130.

Figure 9:
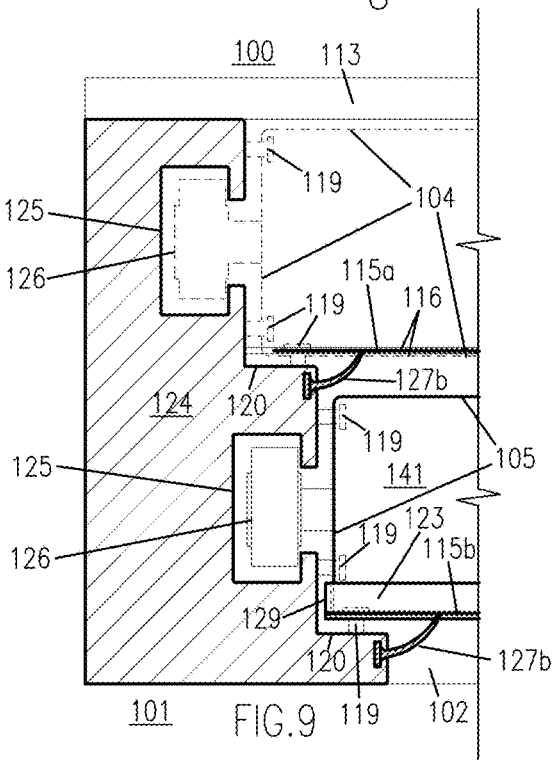
FIG. 9 is a partial horizontal section of the first embodiment through the jamb of the open window as equipped with fin type edge seals.

FIG. 9 is a partial horizontal section of the first embodiment through jamb member 124 of the open window assembly, as in FIG. 7, but showing an alternate edge seal embodiment wherein the edge seals 127*b* are formed from elastic weatherstripping fins and fixed to said jamb in such position that said fin seals stay in sufficient proximity to said screen fabric that flying insects cannot pass between the two.

Figure 10:
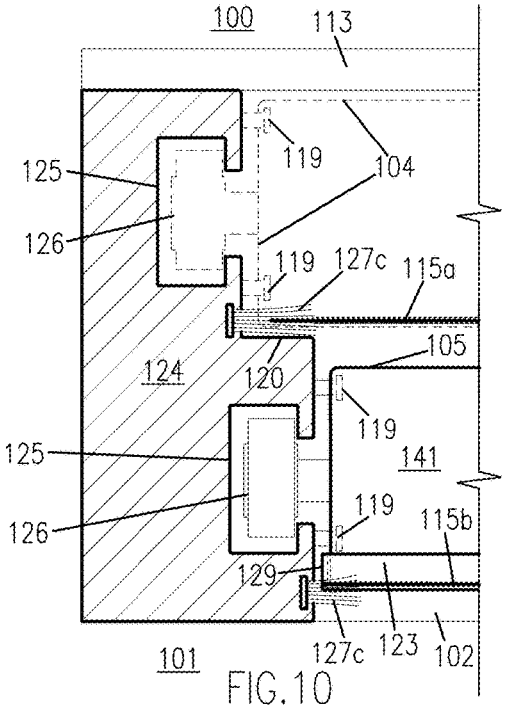
FIG. 10 is a partial horizontal section of the first embodiment through the jamb of the open window as equipped with brush type edge seals.

FIG. 10 is a partial horizontal section of the first embodiment through jamb member 124 of the open window assembly, as in FIG. 7, but showing an alternate edge seal embodiment wherein the vertical edges of screen fabrics 115*a* and 115*b* are encased by brush type edge seals 127*c*.

FIG. 11 is a partial horizontal section of the first embodiment through jamb member 124 of the open window assembly, as in FIG. 8, but showing track 130 recessed into the weather side 101 rather than the jamb 124 side of each stile member 141 forming the vertical sides of the sash.

Figure 12:
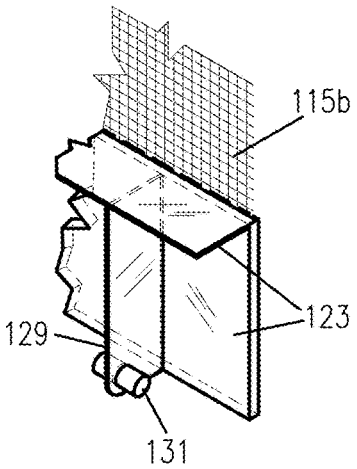
FIG. 12 is an isometric view of a possible pivot bracket for the first embodiment when equipped with a weather-side track.

FIG. 12 is an isometric detail related to the first embodiment as presented in FIG. 11, showing an arrangement for the bracket 129 that connects screen rail 123 to upper sash 105, including a pivot 131 suited for a track 130 having a T-style cross-section and running along the weather side 101 face of stile 141.

Figure 13:
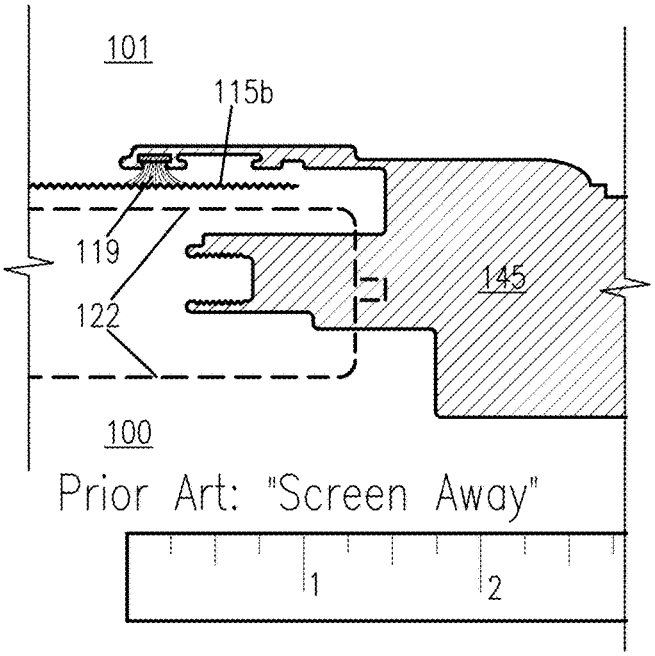
FIG. 13 is a partial horizontal section of prior art.

FIG. 13 is a partial horizontal section of prior art, presented full size, depicting the jamb of a Screen Away product with a vertically sliding sash, produced by the Larson Manufacturing Co. of South Dakota, as discussed in the BACKGROUND portion of this disclosure, the figure showing screen fabric 115 dispensed from an upper rollup screen assembly 122 and said fabric stretched taut across pile fiber weatherstripping 119 mounted in an extruded aluminum enclosure 145.

Figure 14:
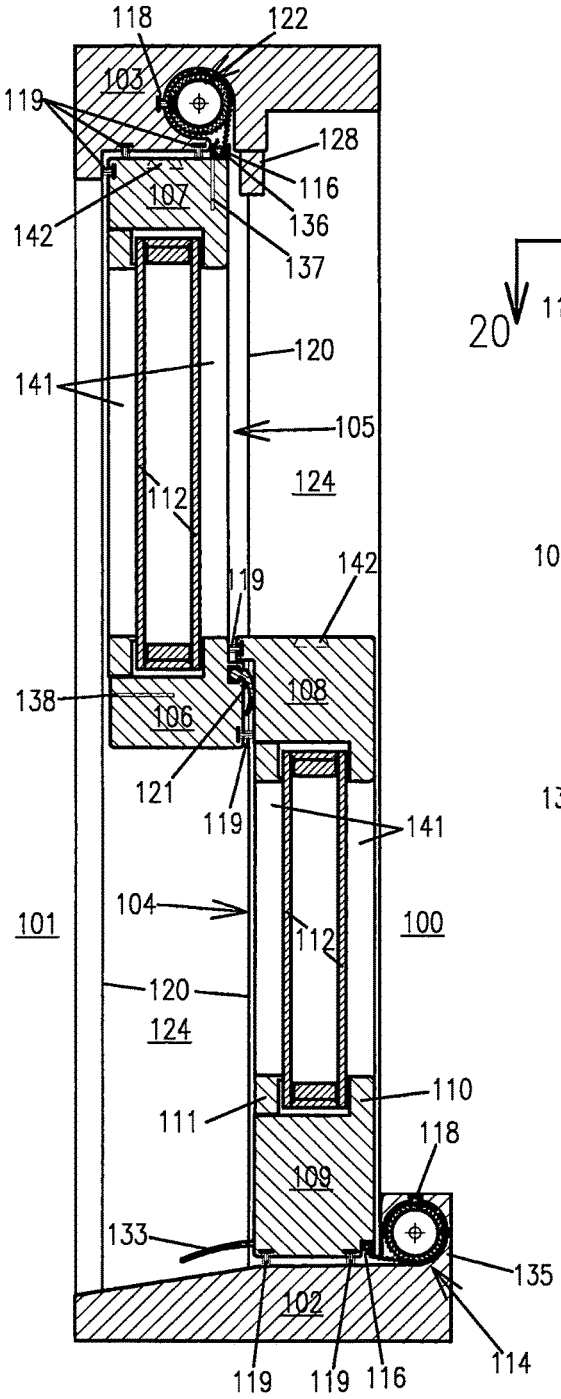
FIG. 14 is a second embodiment of the first embodiment depicted in FIG. 1.

FIG. 14 is the same as FIG. 1 except that it shows a second embodiment wherein insect screens 115*a* and 115*b* do not necessarily roll up and down in approximate line with the weather side 101 of the upper sash 105 and lower sash 104 as in the first embodiment. Screen fabric 115*a* is shown rolling off from the bottom of rollup assembly 114, however said fabric may, just as readily, roll off from the top of said assembly.

Figure 15:
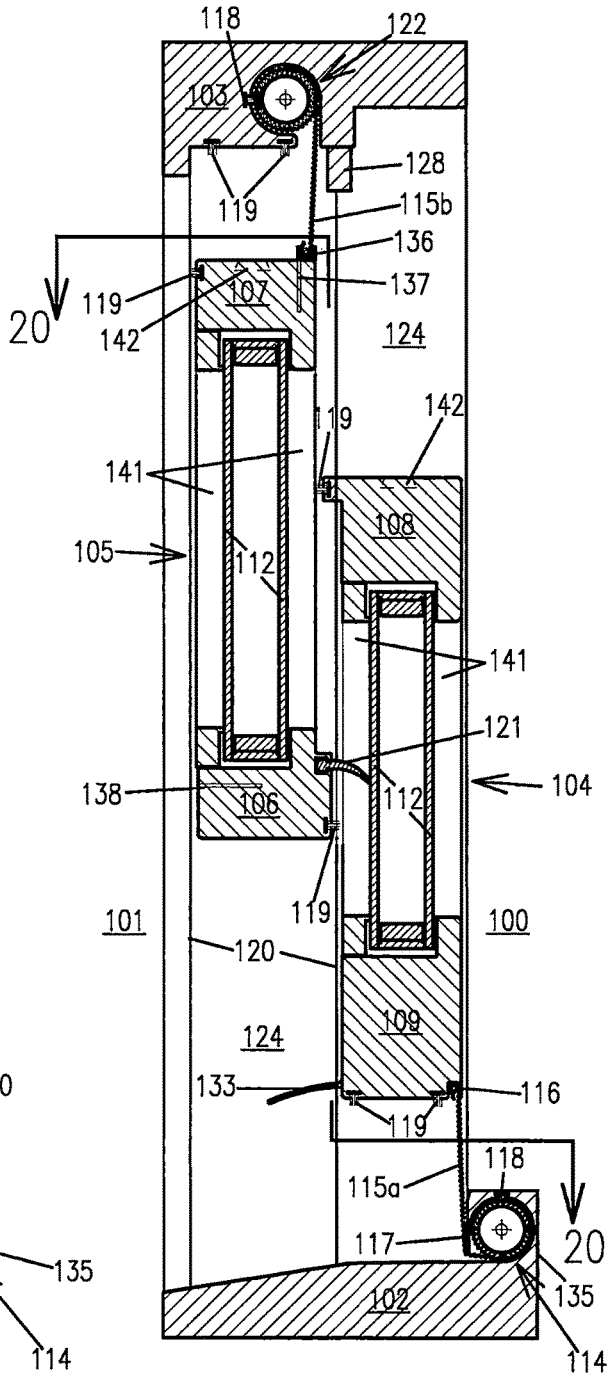
FIG. 15 is a second embodiment of the first embodiment depicted in FIG. 2.

FIG. 15 is the same as FIG. 2 except that it shows a second embodiment as described in FIG. 14. The upper screen fabric 115*b* is attached to upper sash 105 by way of a detachable screen rail 136 and its attendant screen rail upper catch 137.

Figure 16:
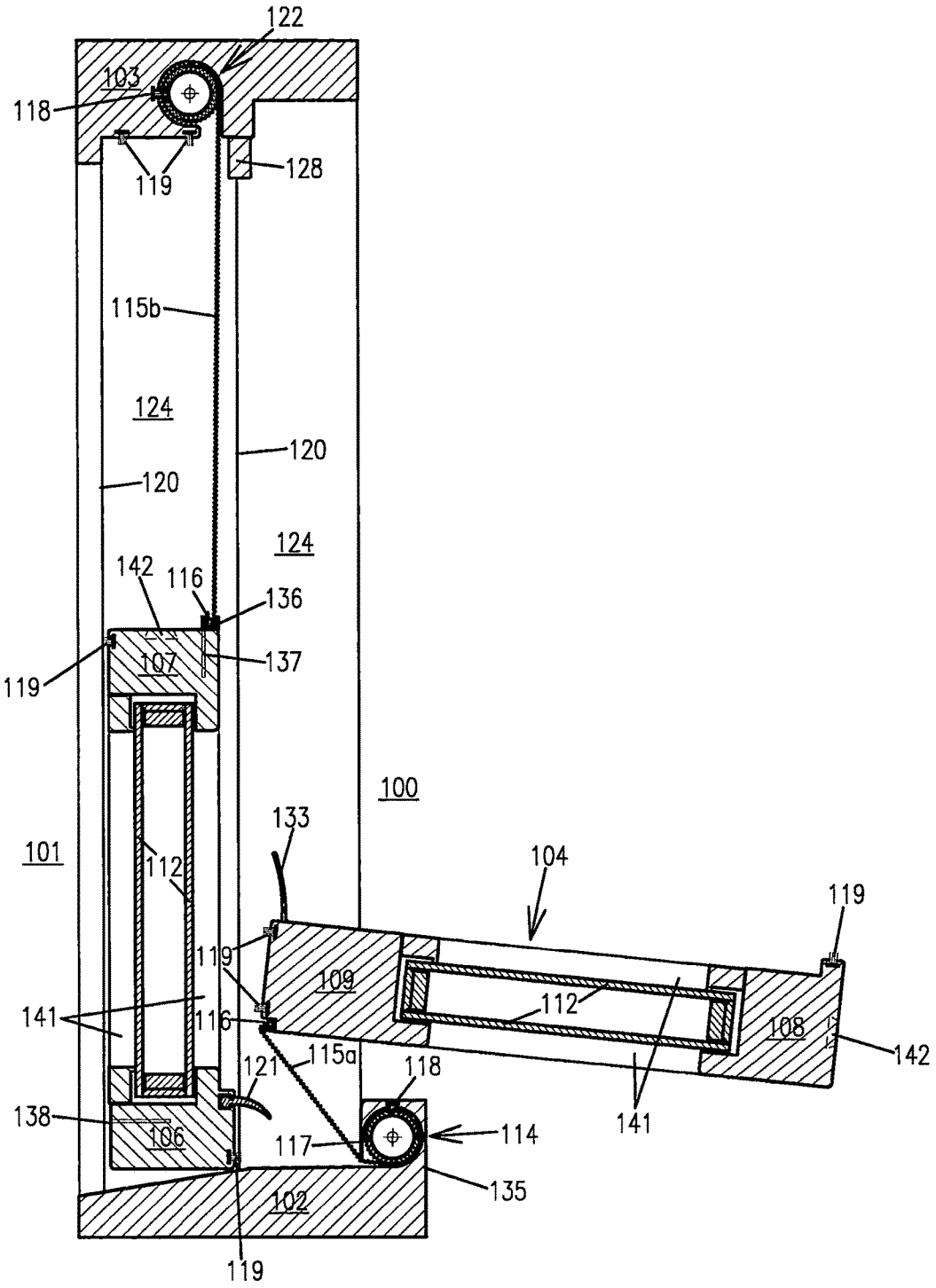
FIG. 16 is a second embodiment of the first embodiment depicted in FIG. 3.

FIG. 16 is the same as FIG. 3 except that it shows a second embodiment as described in FIG. 14. The upper screen fabric 115*b* remains attached to upper sash 105 by way of a detachable screen rail 136 as said sash is lowered during the cleaning of lower sash 104.

Figure 17:
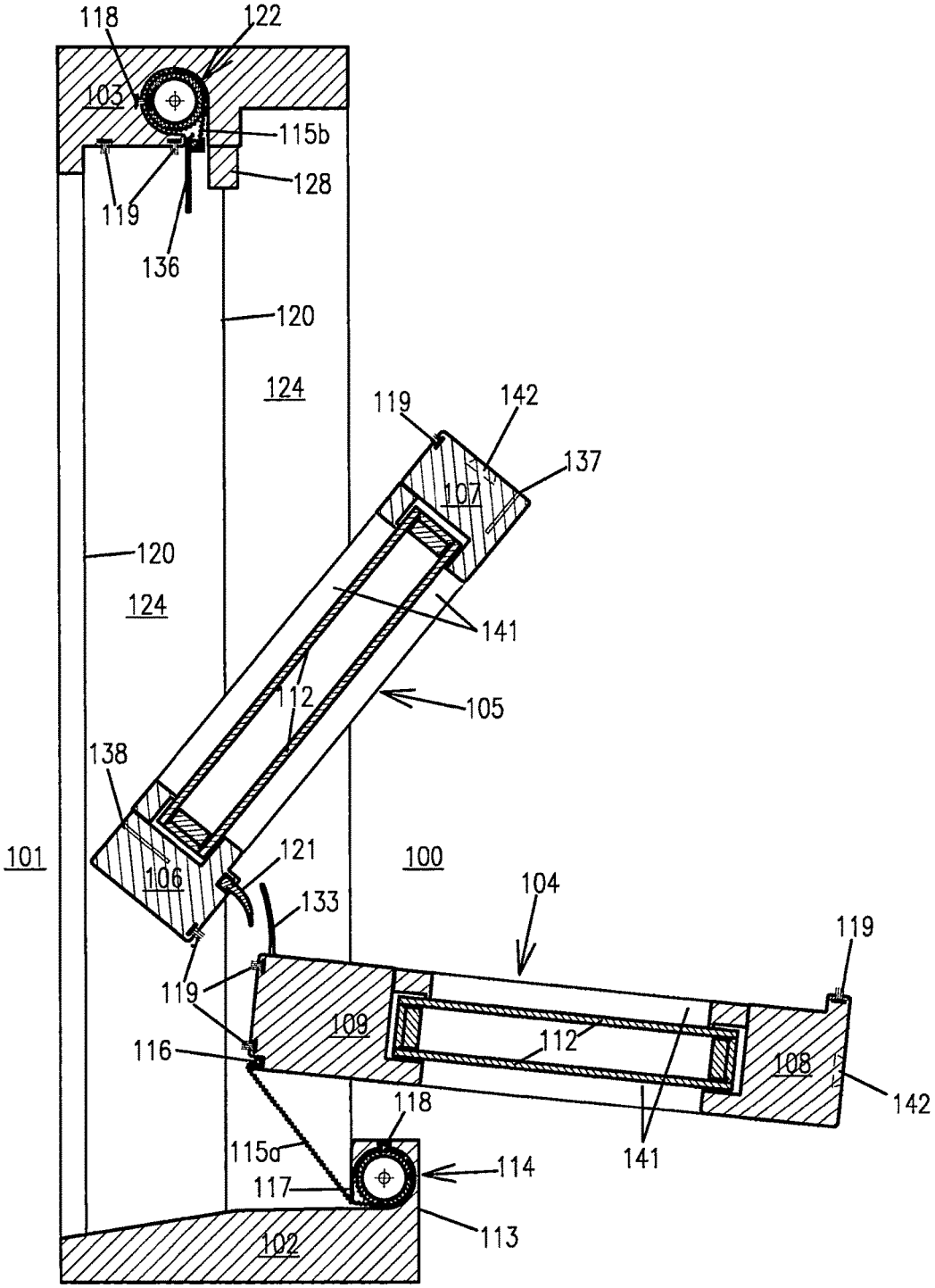
FIG. 17 is a second embodiment of the first embodiment depicted in FIG. 4.

FIG. 17 is the same as FIG. 4 except that it shows a second embodiment as described in FIG. 14. The upper screen fabric 115*b* and its detachable screen rail 136 are shown detached from screen rail upper catch 137, allowing said sash to be tilted for cleaning.

Figures 18, 19:
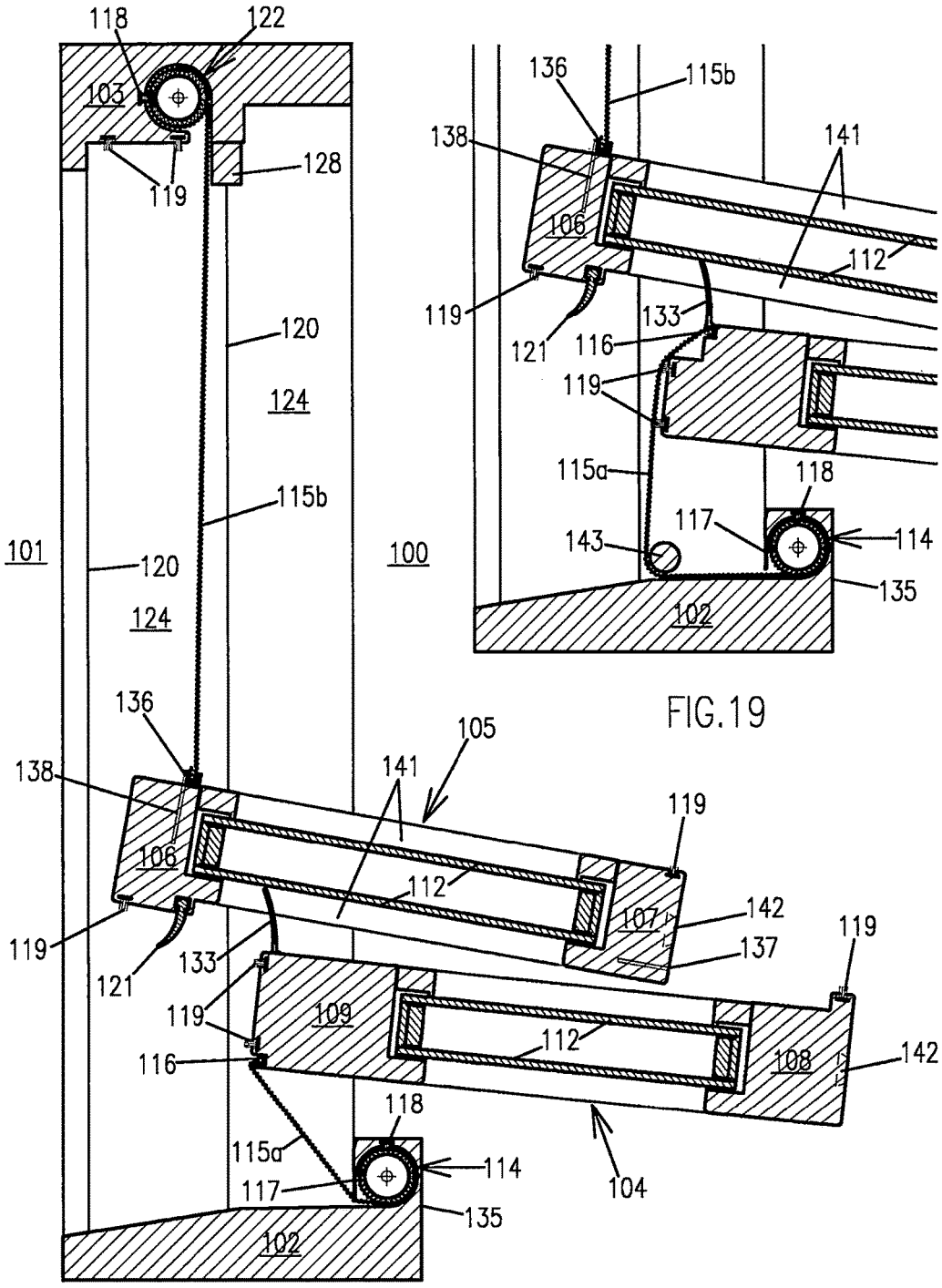
FIG. 18 is a second embodiment of the first embodiment depicted in FIG. 5.
FIG. 19 is a variation on the second embodiment depicted in FIG. 18.

FIG. 18 is the same as FIG. 5 except that it shows a second embodiment as described in FIG. 14. The upper screen fabric 115*b* and its detachable screen rail 136 have been reattached to upper sash 105 by way of screen rail lower catch 138 recessed into bottom rail 106 of said sash.

FIG. 19 is the same as FIG. 18 except that it shows an alternate arrangement by way of the addition of a rigid rod 139, allowing screen fabric 115*a* to attach to the weather side 101 of bottom rail 109 of the bottom sash 104.

Figure 20:
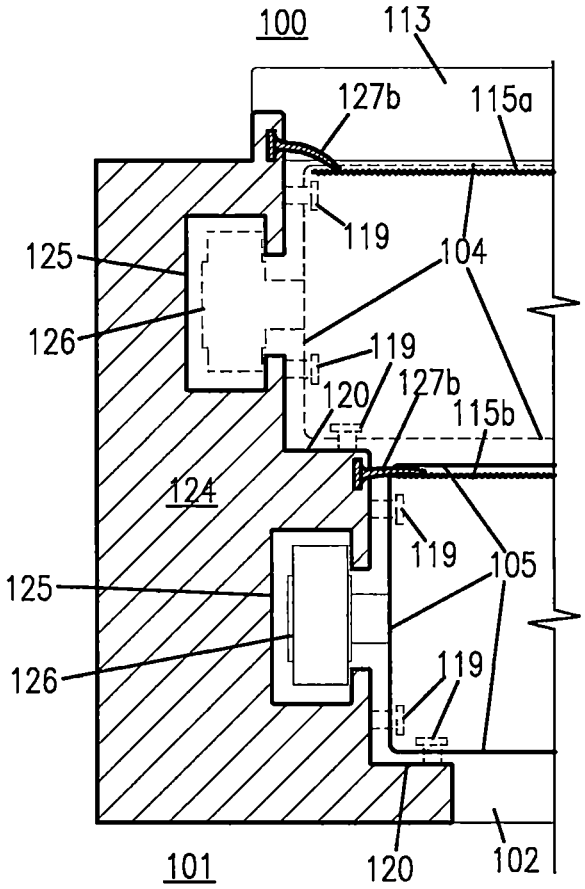
FIG. 20 is a partial horizontal section of the second embodiment through the jamb of the open window as equipped with fin type edge seals.

FIG. 20 is the same as FIG. 9 except that it shows a second embodiment as described in FIG. 14. The fin type edge seals contact screen fabrics 115*a* and 115*b* on their room side 100, said seals being of such flexibility that they may be pushed aside as the sashes are tilted for cleaning.

Reference Numerals

100 room side
101 weather side
102 sill
103 head member of window frame
104 bottom sash

105 upper sash
106 bottom rail of upper sash
107 top rail of upper sash
108 top rail of bottom sash
109 bottom rail of bottom sash
110 fixed glazing stop
111 removable glazing stop
112 glazing
113 sill baffle
114 bottom rollup screen assembly
115 insect screen fabric
115*a* insect screen fabric for lower sash
115*b* insect screen fabric for upper sash
116 insect screen attachment
117 cavity enclosure
118 cavity seal
119 weatherstripping
120 jamb shoulder
121 fin baffle
122 upper rollup screen assembly
123 screen rail
124 jamb member of window frame
125 trackway
126 sash balance/guide
127 edge seal
127*a* pile type edge seal
127*b* fin type edge seal
127*c* brush type edge seal
128 head baffle
129 pivoting end bracket
130 track
131 pivot
132 sliding shoe
133 auxiliary baffle
134 track end stop
135 sill extension
136 detachable screen rail
137 screen rail upper catch
138 screen rail lower catch
139 rigid rod
140 Not Used
141 stile
142 tilt release and upper guide
143 screen guide bar
144 manual force
145 extruded aluminum enclosure

OPERATION

As bottom sash 104 is lifted to open the window for ventilation, fabric insect screen 115*a*, being attached by various means 116 along sill 102, is pulled off of its ordinary rollup screen assembly 114 hidden in bottom rail 109 of said sash while the inherent construction of said rollup assembly keeps said screen fabric taut and engaged with edge seals 127. As either or both of the sashes open, fin baffle 121, stored between meeting rails 106 and 108, extends to fill the gap created between the glazing 112 and said adjacent sash as a sash is opened.

As upper sash 105 is lowered to open the window for ventilation, its fabric insect screen 115*b*, by being attached along the top of said sash by way of screen rail 123 and its end brackets 129, is pulled off of its ordinary rollup assembly 122, hidden in head member 103 of the frame of said window, while the inherent construction of said rollup assembly keeps said screen fabric taut and engaged with edge seals 127 shown in FIG. 7, FIG. 9 and FIG. 10.

When it is time to clean the windows, upper sash 105 is lowered until it is proximate to sill 102, extending its screen fabric 115*b* so as to provide a barrier to insect intrusion all across the window. Then lower sash 104 is lifted an inch or two and tilted inward, as is customary for tilt-to-clean windows, which tilting automatically fills the gap between said sash and sill 102 with screen fabric 115*a;* and, in case the bottom rail 106 of said upper sash is not in contact with said sill, fin baffle 121 ensures closure against insect intrusion by contacting the lower screen fabric 115*a*.

After the cleaning of lower sash 104 is complete, upper sash 105 is prepared for cleaning by being raised a few inches and tilted inward, as is customary for tilt-to-clean windows. The tension in attendant fabric 115*b* causes screen rail 123 to rotate about its pivoting end brackets 129, away from head rail 107 and, as said sash continues to tilt into its cleaning position, the tension in said fabric starts to pull each said pivoting end bracket along the length of track 130, said track being included into each vertical stile 141 of said sash. The friction involved in such transport will require manual force 144 be exerted in order for said pivoting end brackets to transcend the entire distance of said tracks and such force will need to be exerted further in order to latch said screen rail so that, by being latched, said screen rail may maintain each screen edge in proximity to the edge seal 127 at each jamb, resealing the vertical edges of said fabric against flying insect intrusion.

The means of accomplishing said latching may be any convenient arrangement; however, for the sake of illustrating that a latch mechanism may be readily provided, even one not requiring the use of tools in order to be effectual, a latching mechanism is presented herein, it being a result of each said track being bent slightly as it passes bottom rail 106 of said sash, said bend making the distance between the track and the weather side 101 of said sash greater relative to that same distance along the majority of said track and, thus, when each said pivoting end bracket 129 meets stop 134 at the end of each said track, the distance between the bottom of screen rail 123 and pivot 131 for said end brackets is found to be slightly less than the distance between said pivot and the weather side 101 face of said bottom rail, just enough less such that when said screen rail is manually pressed toward the weather side 101, the elasticity of the components and their joints allows the bottom of said screen rail to pass over the outside corner edge of said bottom rail, snapping screen rail 123 into a fixed position snug to shoulder 120 in jamb 124.

With said screen rail being latched into place, said screen fabric in combination with fin baffle 121, auxiliary baffle 133 and the screen fabric for the lower sash 115*a*, seal off the window against flying insects while upper sash 105 is cleaned.

When the glass cleaning process is complete, said screen rail is unlatched from bottom rail 106 by pulling up on the top of upper sash 105 and rotating the outer lower horizontal corner of said sash until said corner is forced under the bottom of said screen rail, or said screen rail may be unlatched by pulling on the top of said screen rail.

Then as said sash is manually tilted back up into its primary, vertical position, the tension in screen fabric 115*b* provided by upper screen rollup assembly 122, draws said screen rail to the top of upper sash 105, completing the tilt-to-clean cycle.

Alternately, in order to move upper screen fabric 115*b* out of the way of cleaning upper sash 105, a somewhat differently configured screen rail 136 may be manually transported from the top to the bottom of the weather side 101 of said sash by unclipping catches 137 used to attach said screen fabric to the top of said rail and then reclipping said screen rail to catches 138 at the bottom of said sash, said catches being composed of any number of mating clip arrangements.

CONCLUSION, RAMIFICATIONS AND SCOPE

Accordingly, the reader will see that double hung windows of the tilt-to-clean variety can be conveniently protected against flying insect intrusion with rollup screens stored out of view in the window construction when sashes are closed, and that when sashes are opened for ventilation, those openings automatically fill with insect screen, and the reader will see that such protection continues to be afforded even when the sashes are tilted for cleaning, except for, at most, a few seconds when one or two simple, tool-less procedures may be required to reposition the upper screen. Thus, the convenience of tilt-to-clean windows is enhanced by providing clearer views for room occupants when the sashes are closed and screens are not needed.

Although the descriptions above provide much specificity, they should not be construed as limiting the scope of the embodiments but as merely providing illustrations of several embodiments. For example, the screen rail may be latched into its necessary positions by any of a wide variety of devices and arrangements, and the screen fabrics may be located toward the room side or the weather side of the window assembly according to what a window manufacturer thinks is suitable to integrate edge seals into the geometries of its jamb and sash profiles.

What is claimed is:

1. An apparatus comprising:

a double-hung window having an upper sash and a lower sash operable within a window frame, said upper sash having an upper glazing, said lower sash having a lower glazing, each of said upper sash and said lower sash having a top rail and a bottom rail;

said window frame having a horizontal window frame head member having one end connected to an upper end of a first vertical window jamb and an opposing second end of said head member connected to an upper end of a second vertical window jamb, and a horizontal sill member connected between respective lower ends of said window jambs;

a first screen rollup assembly comprising an upper insect screen and a first rollup shaft;

said upper insect screen having a topmost horizontal end attached along the first rollup shaft, said first rollup shaft being mounted inside of and spanning a length of a longitudinal cavity within said head member, said upper insect screen having a bottom horizontal end attached to a screen rail, said screen rail being attached to said upper sash;

wherein said upper insect screen is configured to unroll from said rollup shaft when said upper sash is moved vertically away from said head frame member into a ventilation position and when said upper sash is titled away from said window frame into a tilted position;

wherein said screen rail is attached to said upper insect screen and being of a length to maintain said upper insect screen taut between vertical edges of said upper insect screen, said screen rail being positioned horizontally on a weather-side surface of the upper sash by a rigid bracket attached proximate to each longitudinal end of said screen rail, each bracket being pivotally engaged to a respective trackway provided to said upper sash and each bracket being arranged to locate said screen rail proximate to the top rail of the upper sash when said upper sash is in said ventilation position; each trackway being vertically aligned when said upper sash is positioned in said ventilation position;

each trackway guiding the respective bracket as said screen rail moves from an uppermost portion of said upper sash to a lowermost portion of the upper sash when said upper sash is moved into said tilted position; and a second screen rollup assembly comprising a lower insect screen and a second rollup shaft;

said lower insect screen having one horizontal edge attached to the second rollup shaft, and said second screen rollup assembly connected between said lower sash and said sill member;

wherein said lower insect screen is configured to unroll from said second rollup shaft when said lower sash is moved away from said sill member into a ventilation position and when said lower sash is tilted away from said window frame into a tilted position;

said window frame having a first edge seal comprising a first straight section of weatherstripping having a first weather excluding element extending from the sill member to the head member along each vertical window jamb including jamb shoulders incorporated into said jambs and does not interfere with movement of said upper sash; each first weather excluding element maintains continuous contact with a region immediately adjacent to a vertical edge of said upper insect screen when said upper sash is in said ventilation position and when said upper sash is in said tilted position;

said window frame having a second edge seal comprising a second straight section of weatherstripping having a second weather excluding element extending vertically along each vertical window jamb including jamb shoulders incorporated into said jambs and extending from said sill member to at least a position of the bottom rail of the lower sash when said lower sash is in its ventilation position, and does not interfere with movement of said lower sash; each second weather excluding element maintains continuous contact with a region immediately adjacent to a vertical edge of said lower insect screen when said lower sash is in said ventilation position and when said lower sash is in said tilted position;

a fin baffle comprising a flexible fin member, said fin baffle attached to said upper sash or said lower sash in a horizontal longitudinal cavity provided between the bottom rail of the upper sash and the top rail of the lower sash when the sashes are each in a closed position, said fin baffle remains flexed in said cavity between said upper sash and lower sash until said upper sash is moved into its ventilation position or when said lower sash is moved into its ventilation position, and said bottom rail of the upper sash passes the top rail of the lower sash and said fin baffle un-flexes and extends horizontally out from said upper sash to continuously contact said upper sash or lower sash thereby sealing off a gap between the upper sash and the lower sash;

an auxiliary baffle formed as a fin attached horizontally along the bottom rail of the lower sash and extending from the first window jamb to the second window jamb and projecting substantially perpendicular from said bottom rail of the lower sash, said auxiliary baffle having a profile matched to the cross-sectional profile of the upper sash when both said upper sash and said lower sash are in their respective tilted positions, said auxiliary baffle continuously contacts said upper sash and said upper glazing to thereby seal off a gap between said upper and lower sashes when said upper sash and said lower sash are both in their respective tilted positions.

2. The apparatus of claim 1, wherein:

said first and second weather excluding elements each primarily comprise a fibrous pile.

3. The apparatus of claim 1, wherein:

said first and second weather excluding elements each primarily comprise a flexible fin with a vertically oriented longitudinal edge.

4. The apparatus of claim 1, wherein:

said first and second weather excluding elements each primarily comprise a fibrous brush having fibers of static propensity, form, and spacing to induce vertical edges of said upper and lower insect screens to enmesh within or cling to or enmesh within and cling to said fibers as each screen unrolls.

5. The apparatus of claim 1, wherein:

said first and second weather excluding elements each primarily comprise a magnet; and each of said upper insect screen and said lower insect screen is furnished with a plurality of magnetic threads in a region immediately adjacent to vertical edges of said upper and lower insect screens, whereby the attraction of said magnetic threads to said magnet of said first and second weather excluding elements attaches each screen fabric to the respective edge seals.

6. The apparatus of claim 1, wherein:

each trackway is recessed into said upper sash along the weather-side surface of said upper sash and is formed as a straight, longitudinal hollow structure of uniform cross-section spatially connected to the weather-side surface of said upper sash by an open channel, said channel allowing said respective bracket to engage the trackway throughout an entire length of the trackway.

7. The apparatus of claim 1, wherein:

each trackway is located on the weather-side surface of said upper sash and extending out from the weather-side surface of the upper sash.

8. The apparatus of claim 1, wherein:

each trackway is recessed into said upper sash along opposed surfaces of said upper sash that are immediately adjacent to a space between said upper sash and the respective adjacent window jamb.

9. The apparatus of claim 1, wherein:

each trackway is straight throughout its length.

10. The apparatus of claim 1, further comprising:

a lock configured to lock a location of each said bracket when said bracket moves along the respective trackway to a trackway end proximate to a bottom side of the bottom rail of said upper sash and meets a track end stop, said lock maintaining a vertical edge of said first insect screen fabric in contact with said first weather excluding element of said first edge seal when said upper sash is in said tilted position.

11. The apparatus of claim 6, wherein:

a bend is further provided to a region proximate a bottom end of each trackway, when said upper sash is moved to the tilted position, said bend guides said screen rail closer to said upper sash until the screen rail contacts a lowermost portion of the upper sash;

the screen rail is prevented from passing a bottom edge of the upper sash until a first manual force is applied to said screen rail parallel to the sill and in an outward direction, said first manual force elastically reshaping said screen rail until a portion of said screen rail passes a bottom edge of the upper sash;

when said first manual force is withdrawn, said screen rail regains its original shape and remains locked until a second manual force is applied to said screen rail in a direction opposite to the first manual force so that the screen rail is moved along the trackways.

12. The apparatus of claim 1, further comprising:

an enclosure attached to a top side of the sill member along a length of the sill member on a room-facing side of the lower sash, said enclosure housing said second rollup shaft of said second roll up assembly; said one horizontal edge of said lower insect screen being a lower horizontal edge of said lower insect screen and attached to said second rollup shaft, and a topmost horizontal end of the lower insect screen being attached along a room-facing surface of the bottom rail of the lower sash and extending longitudinally from one end of the bottom rail to an opposite end, a weather-side face of the enclosure being furnished with an opening for guiding said lower insect screen as it is rolled up on and rolled out from said second rollup shaft during movement of the lower sash for ventilation.

13. The apparatus of claim 1, further comprising:

an enclosure attached to a top side of the sill member along a length of the sill member on a room-facing side of the lower sash, said enclosure housing said second rollup shaft of the second rollup assembly, said one horizontal edge of said lower insect screen being a lower horizontal edge of said lower insect screen and attached to said second rollup shaft, and a topmost horizontal end of the lower insect screen being attached along a weather-side face of the bottom rail of the lower sash and longitudinally extending from one end of the bottom rail to an opposite end, a weather-side face of the enclosure being furnished with a passage for guiding said lower insect screen as it is rolled up on and rolled out from said second rollup shaft during movement of the lower sash for ventilation; and a rigid screen guide bar attached from the first window jamb to the second window jamb, whereby the lower insect screen is guided across and in contact with the sill member during the movement of the lower sash for ventilation and the vertical edges of the lower insect screen are placed in continuous contact with the weather excluding elements of the second edge seal.

* * * * *